US006473924B1

(12) United States Patent
Sørbø et al.

(10) Patent No.: US 6,473,924 B1
(45) Date of Patent: Nov. 5, 2002

(54) SUPPORT PAD

(75) Inventors: Lars Sørbø , Oslo (NO); Atle Aas, Oslo (NO)

(73) Assignee: Freebag AS, Oslo (NO)

( * ) Notice: Subject to any disclaimer, the term of this patent is extended or adjusted under 35 U.S.C. 154(b) by 0 days.

(21) Appl. No.: 09/623,742

(22) PCT Filed: Oct. 6, 1999

(86) PCT No.: PCT/NO99/00305

§ 371 (c)(1),
(2), (4) Date: Jun. 25, 2001

(87) PCT Pub. No.: WO00/19868

PCT Pub. Date: Apr. 13, 2000

(30) Foreign Application Priority Data

Oct. 7, 1998 (NO) ..... 19984683

(51) Int. Cl.[7] ..... A47C 27/00

(52) U.S. Cl. ..... 5/655.4; 5/702; 5/654; 5/705; 5/911; 5/731; 5/737

(58) Field of Search ..... 5/702, 731, 737, 5/705, 644, 654, 655.5, 911, 652, 420

(56) References Cited

U.S. PATENT DOCUMENTS

| | | | | |
|---|---|---|---|---|
| 3,459,179 A | 8/1969 | Olesen | 5/655.4 |
| 4,011,611 A | 3/1977 | Lederman | 5/655.4 |
| 4,194,254 A | 3/1980 | Torrez | 5/420 |
| 4,689,844 A | 9/1987 | Alivizatos | 5/465 |
| 4,748,768 A | 6/1988 | Jacobsen | 53/428 |
| 4,754,511 A | 7/1988 | Sargent | 5/655.4 |
| 5,079,787 A | 1/1992 | Pollmann | 5/655.4 |

FOREIGN PATENT DOCUMENTS

| | | |
|---|---|---|
| DE | 2 307 938 | 8/1974 |
| DE | 2 311 054 | 9/1974 |
| DK | 121398 | 10/1971 |
| GB | 2 128 080 | 4/1984 |
| NO | 168866 | 4/1992 |

*Primary Examiner*—Alexander Grosz
(74) *Attorney, Agent, or Firm*—Finnegan, Henderson, Farabow, Garrett & Dunner, L.L.P.

(57) ABSTRACT

A sitting, sleeping or support pad (1), which on account of its special design can be used in a number of different areas of application, includes an inner bag with a fill material, disposed in an outer bag. The inner bag has an elongated, substantially rectangular shape and the outer bag consists of first and second sides (2, 3), with a I substantially similar shape to the inner bag, where between the outer bag's first and second sides (2, 3), at least in a part of the bag's length against one of the short sides of the outer bag, there is provided an intermediate piece (6) and an end portion (4) is formed on at least one short side. The end portion (4) is enlarged and provides the opportunity for the pad to be placed on the short side, as well as for all or most of the fill material to be collected in a part of the inner bag, thereby to provide co-operation between inner bag and outer bag to achieve a sitting position where the user is raised above ground level.

8 Claims, 2 Drawing Sheets

SUPPORT PAD

BACKGROUND OF THE INVENTION

1. Field of the Invention

The present invention relates to a sitting, sleeping or support pad which, on account of its special design, has a number of different areas of application and which can be easily adapted to different users and situations. A preferred embodiment of the invention is particularly suitable for use in a maritime environment.

2. Description of the Related Art

In a number of leisure situations there is a need for a pad on which a user can sit, recline or be supported. However, the requirements often change according to the various leisure activities involved and therefore different objects have traditionally been employed as pads. A cushion or sheet can be employed as a sitting pad during a trip in the country or in different situations such as on board a boat. The common requirement for sitting pads is that they should provide a soft sitting surface which counteracts any rough ground, in addition to which they should provide insulation, thus giving the user a comfortable seat without the discomfort, e.g., of sitting on a cold or damp surface. In some situations, moreover, it is also desirable to adjust the thickness of the sitting pad, thereby enabling the user to adjust the height to a desired height above ground level. The need may also arise to alter the sitting position after a time, particularly where there is no possibility of obtaining back support. There may also be a need to improve the user's view, for example in a boat where, depending on the boat's design, a user often wishes to sit at a distance above the deck or thwart in order to be guaranteed a good view ahead and to the sides when the boat is underway.

To some extent, the same functions are covered by a sleeping pad with regard to comfort and insulation. A sleeping pad should be capable in a simple manner of giving the user a level, soft surface which counteracts the roughness of the ground in addition to providing insulation if the ground is damp or cold. Should the user also wish a special reclining position, for example, with the upper part of his body slightly angled relative to his legs, the sleeping pad should be capable of being adapted to conform to the user's reclining position, thereby providing a comfortable reclining position and insulation in any position. In addition, a good sleeping pad will adapt to the user's anatomy, conforming to some extent to the user's sleeping surface. A sleeping pad should be easily accessible, i.e., it should be light in weight, thus enabling it to be easily transported by a user, and should be easy to stow away during the periods when it is not in use.

In addition, there is often a need for a support pad, e.g. such as a back support, neck support, or a support for individual parts of the body, in order to provide a better sitting or reclining position or to relieve the pressure on the body in certain situations, such as when recovering after an injury or the like. For a leisure user a number of areas of application may be mentioned in this connection, for example, as a back support during hunting or when out in the woods and fields, as a support during sailing, or simply as a support for back seat passengers who wish to rest in a car.

The use is known in the prior art of various forms of cushions, or mattresses of different thickness and shape to cover the above-mentioned requirements. Such cushions and/or mattresses may be made of a foam material or may consist of a cover filled with a fill material. As a sitting pad a flat cushion is usually chosen with the thickness required to cover the requirements for comfort and insulation, and as a sleeping pad the requirements for ease of transport, size and weight will also be crucial. A sleeping pad for use on a beach, skerries or the like will have to be easy to transport, light in weight and of a size which enables it to be carried without too much trouble. It will also be necessary to have a kind of support arrangement or the like on sleeping pads of this type. The most common articles for support in various situations are also cushions of different shapes, and for this purpose specially sewn cushions with a specific shape are used, or a cushion with a fill may be adapted to the individual need. It is natural to distinguish between a cushion with a fixed shape which has little ability to be adapted to different requirements, and a cushion whose shape can easily be altered, thereby allowing it to be adapted to several areas of application.

One kind of sitting or sleeping pad, and to some extent support pad, which differs from ordinary types of cushion and mattress is a sack with a fill material which, on account of its degree of fill and its shape permits the user to form it according to his own wishes and requirements. Sacks of this kind are often referred to in the trade as "saccosacks", and can be adapted to a variety of sitting and reclining positions. The disadvantage of the saccosack, however, is that it is unstable with regard to shape and there is therefore little possibility of the user giving it a shape and there is little possibility of the user giving it a shape which is substantially different from that given by the sack's external features and the dimensions thereof. For example, it will not be possible to pack the contents of a traditional saccosack together in order to achieve a sitting position which is substantially higher than ground level, and then to change the shape to, e.g., a sleeping pad which is substantially flat. Such a bag therefore provides a very limited choice of sitting and reclining positions.

Other examples of the prior art which partially fulfill the same functions are mentioned in Norwegian patent NO 168866, where a mattress is disclosed consisting of two outer layers of cotton, under which there are placed two layers of foamed plastic and where these four layers with seams are sewn together to form cavities or channels which are filled with particles of synthetic material. Such a mattress provides ventilation which can remove moisture and keep the body warm by means of insulation while the mattress can also be used amongst other things to prevent bed sores and the like. Another known solution related to this is described in Danish patent publication 121398, concerning a cushion with a fill of small rounded plastic particles and a soft cover of a gauze-like material. Furthermore, from German laid-open publication 2307938 there is known a sitting pad which consists of a fill of foamed plastic beads or the like with a nylon cover. There is also known from German laid-open publication 2311054 a similar cushion which has a cover of a fabric material. These solutions, however, provide a mattress, which can of course be folded to form a sitting pad or also a support pad, but thereby giving a layered division of the sitting, sleeping or support pad which provides characteristics different to the solution in the present invention with regard to forming ability and the ability to adapt to a user's anatomy and the shape of the ground. Moreover, these have a different structural design in relation to the object of the invention.

Furthermore, in U.S. Pat. No. 4,689,844, there are described support cushions which are assembled to form a sitting, sleeping or support pad. The pads are made of a flexible material with a chamber or cavity which is filled to approximately 50% of its maximum normal volume with relatively small expanded polystyrene bits. When the cushions are laid in a row they will form a sleeping pad, and by folding this a kind of sitting or support pad can be obtained, which will also be capable of providing the required sitting height above the ground. However, the pad is divided into chambers as it consists of individual cushions which are placed in an outer cover. Even though the degree of fill of each individual pad is around 50% of the cushion's volume, the distribution in the pad will be restricted by the fact that each chamber in the pad is given an amount of fill material and the distribution of the fill in the pad will not be able to deviate from this. Thus, it is not possible to collect all of the fill in specific parts of the pad.

SUMMARY OF THE INVENTION

In the present invention an outer bag and an inner bag are employed, where the outer bag has an elongated substantially rectangular shape and contains a fill material, and where the outer bag has a first and a second side with a substantially similar shape to the inner bag. The pad is characterized in that between the outer bag's first and second sides, at least in a part of the bag's length, against one of the outer bag's short sides, there is provided an intermediate piece and on the said short side of the outer bag an end portion is formed between the first and the second sides. The intermediate piece on the outer bag's said short side provides a wedge-shaped increasing distance between the first and second sides, changing into an enlarged end portion along the short side. The fill material is selected from a group consisting of material in pellet or powder form. In a preferred embodiment the degree of fill in the inner bag is preferably less than 60%, but according to the design of the outer bag this degree of fill may be higher or lower than 50%. In a preferred embodiment the fill in the inner bag is in globular form, but may also be pellets, coarse powder, bits and variously shaped pieces of a preferably solid material. The fill may be made, for example, of polystyrene foam bits, foam rubber or the like, so that they are preferably stable with regard to shape and the shape of the pad is thereby dependent on how the fill is placed in the inner bag and how it is placed in the outer bag.

The material in the inner bag is preferably elastic, with the result that it expands when the contents, i.e., the fill in the inner bag, are compacted at one end of the bag.

The outer bag has a form which gives special characteristics in co-operation with the elastic inner bag and the fill therein. The outer bag has an elongated, substantially rectangular form and has an enlarged area between the first and second surfaces on at least one of the outer bag's short sides. This enlarged area can be used when the pad has to be used as a sitting pad where it is desirable to give the user a sitting position at a height above the ground. The enlarged area on at least one short side of the outer bag forms a "bottom part" in this case. The stable sitting shape is achieved particularly on account of the co-operation between the outer bag and the inner bag, especially in the area of an enlarged area.

The enlarged bottom area can be achieved in several ways, a preferred form being that the intermediate piece between the first and second sides has an approximately wedge-shaped transition along the side, to the bottom area at one of the short sides of the outer bag. It is possible to form sew the first and second surfaces in such a way that they can change into an enlarged bottom portion. This, however, should be considered to be analogous with the above-mentioned solution with respect to the scope of the attached patent claims.

BRIEF DESCRIPTION OF THE DRAWINGS

The sitting, sleeping or support pad according to the present application will be described in more detail below in relation to the accompanying drawing figures, in which:

In FIG. 1 an embodiment of the object of the invention is viewed in perspective. The pad 1 consists of a first side 2 and a second side 3 which are joined along their outer edges by an intermediate piece 6. The pad 1 is substantially rectangular in shape, and in the embodiment illustrated in FIG. 1 the rectangular shape is slightly narrowed approximately halfway between the short sides of the pad 1. This, however, is only one embodiment and the pad 1 may just as well have a completely rectangular shape. In the embodiment, moreover, the corners are slightly rounded. On one of the short sides of the pad 1 the intermediate area 6 is increasing in width which gives a wedge-shaped piece, providing an increasing distance between the first side and the second side against one of the outer bag's short-sided end portions 4. If the first side 2 and the second side 3 are joined directly along their outer edges, the piece 4 will be wedge-shaped and arranged in such a manner that the distance between the first side 2 and the second side 3 is increasing towards one of the short sides of the pad 1.

FIG. 2 is a view from above illustrating how the pad 1 has an approximately rectangular shape with slightly narrowing areas round the lugs 5. The lugs 5 are intended for attachment of a carrying strap or the like. This is only in order to improve the user characteristics by making the pad 1 more portable. In addition the outer bag of the pad 1 has at least one opening 7 which permits the inner bag to be withdrawn from the outer bag for cleaning etc. of the outer bag as well as the inner bag.

When the pad 1 has to be used as a sitting pad, one takes hold of the short side of the pad 1 which is opposite the area 4 and places the pad 1 on its edge with its short side 4 facing downwards. The fill in the inner bag is then moved to the lower area of the outer bag and on account of the surrounding elastic material in the inner bag in the preferred embodiment, this can then be formed into an oval cylindrical shape inside the outer bag. The size of the inner bag is adapted in such a way that when the fill is packed together in the inner bag, the inner bag is pressed against the inside of the outer bag and the enlarged end portion 4 forms a surface on which the pad 1 stands. A user can now sit down on this and be sitting at a height above the ground. The height is adjusted by how much fill is collected in the "lower" part of the inner bag., In FIG. 3, an embodiment of the pad 1 is placed on edge with the enlarged end piece 4 against the ground. Since the inner bag's degree of fill in the preferred embodiment is less than 50%, it will be possible to collect the fill material in less than half of the outer bag's volume. As illustrated in FIG. 3, the result is that the outer bag 1 "folds" at the middle approximately at the lugs 5, and by distributing the fill in the half of the outer bag where the enlarged piece 4 is located, it will be possible to obtain a stable, tall shape where the half of the outer bag 1 which no longer contains the bulk of the fill hangs down beside the lower part of the outer bag 1.

In FIG. 4 the contents of the inner bag are further compressed and it can be seen that the sides 2 and 3 have a slightly curved shape towards the end piece 4. It can also be clearly seen in FIG. 4 that the half of the pad 1, which is empty of fill, is hanging down to the left of the figure. By compacting fill in one half of the pad 1 and by means of co-operation between the elastic inner bag and the outer bag with a stable shape and enlarged end area 4, it is possible to obtain a tall, standing bag which can be a sitting pad which raises the user from ground level.

Figure 1:
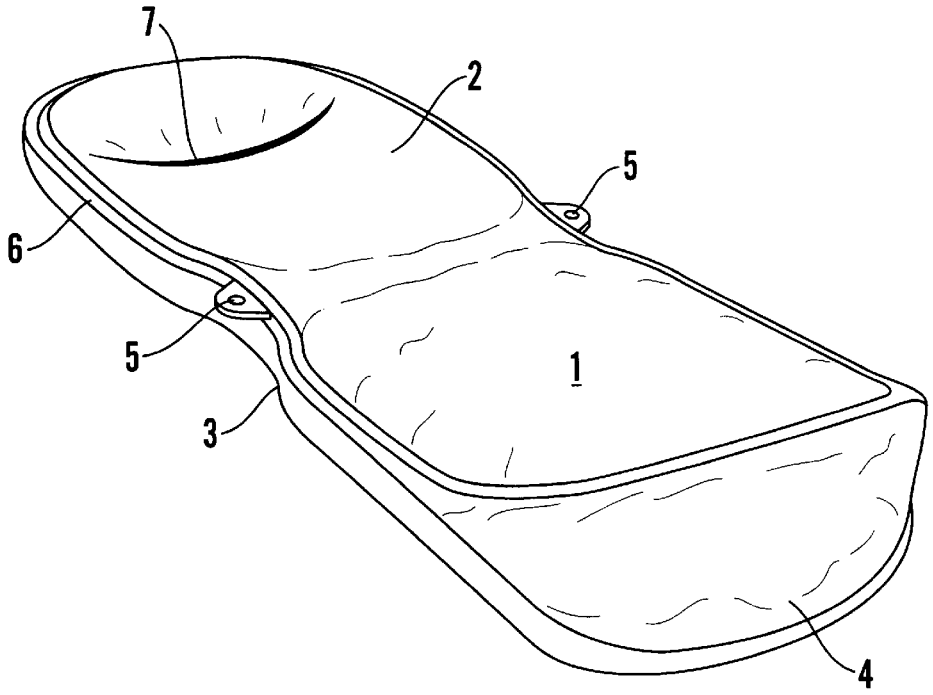
FIG. 1 is a perspective view of the object of the invention with the one enlarged end piece.
Figure 2:
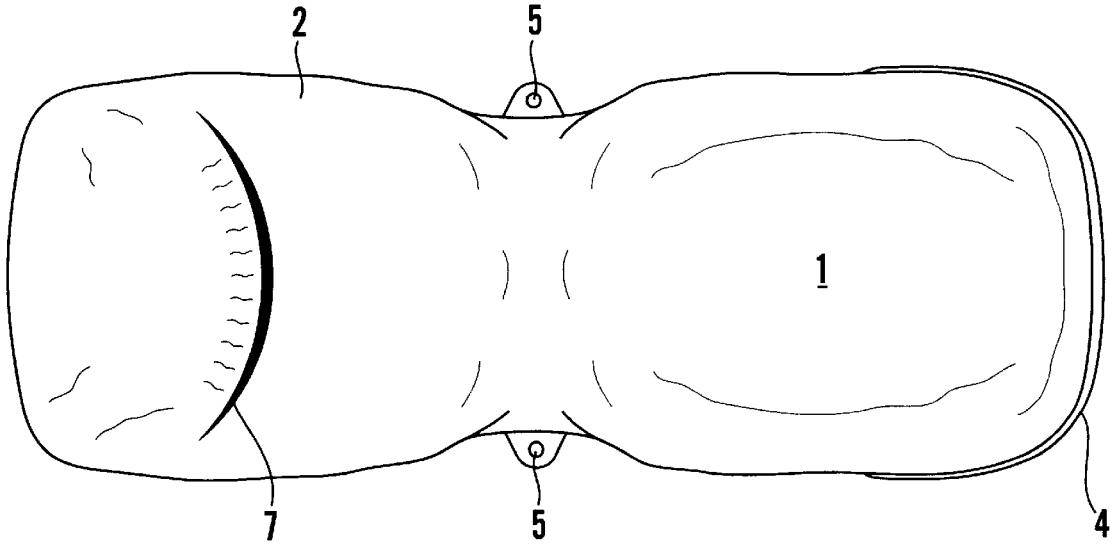
FIG. 2 is a view from above of an embodiment of the object of the invention.
Figure 3:
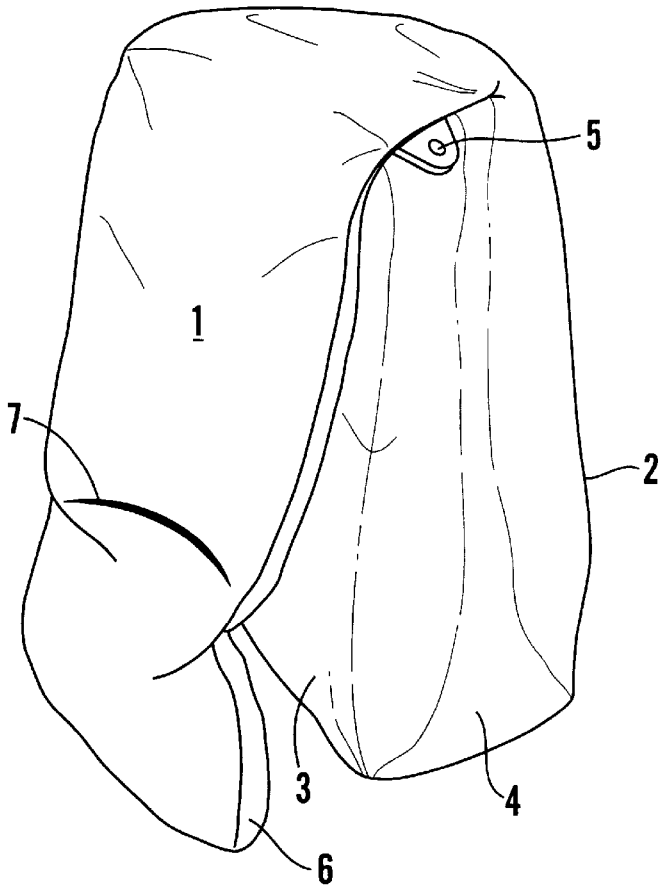
FIG. 3 illustrates the object of the invention folded up for transport or use as a sitting/support pad, with a slim shape.
Figure 4:
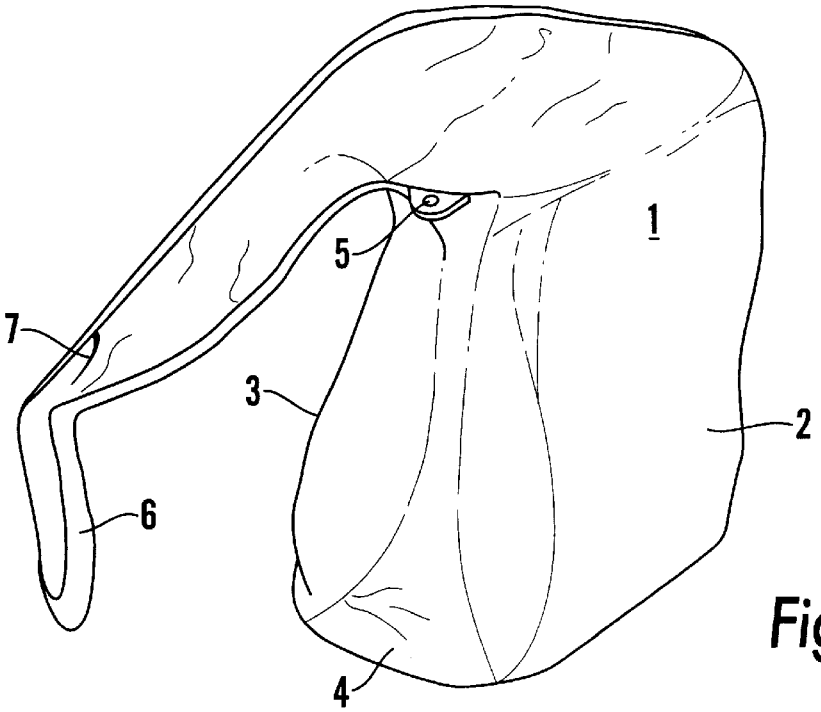
FIG. 4 illustrates the object of the invention in folded form with a thicker profile in the end of the outer bag with the enlarged end portion, where the object of the invention can be used as a sitting pad which raises the user from ground level.

The pad can also be used as a sleeping pad by distributing fill in the inner bag through the whole or most of the inner bag. Due to its rectangular shape it will be possible to distribute the inner bag in most of the outer bag, whereupon the outer bag with an evenly distributed inner bag and the fill therein will constitute a comfortable and insulating mattress/sleeping pad for a user. Due to the inner bag's elastic design in a preferred embodiment, the bag will be able to counteract rough ground and the fill in the inner bag will thus be distributed in such a manner that the pad assumes a relatively level position which gives the user a high degree of comfort.

If one wishes a flat or almost flat sitting pad, e.g., for use on damp ground or the like, parts of the outer bag can be folded away after the fill is distributed in the second part of the outer bag, thus enabling a desired thickness to be obtained for the pad on which one will sit. Here the fill will also be distributed in the interior of the bag and through the interplay between the outer bag with a stable shape, the elastic inner bag and the globular, powdered or granulated fill, a sitting "cushion" will be obtained which provides the desired thickness and thereby insulation and comfort.

Similarly the pad 1 can be shaped in various ways in order to provide support in different situations. If one is sitting on guard when hunting it will be possible to gather the fill at the end of the outer bag which gives an insulating pad on which to sit, and the empty part of the outer bag can be placed against a tree trunk or the like, providing a back support. Thus the full length and rectangular shape of the bag have been utilized to obtain a high degree of sitting comfort. By distributing the fill, the desired degree of insulation and sitting comfort can be achieved, while the outer bag will be able to provide insulation and sitting comfort, e.g., for the back, elbow, etc.

The pad 1 according to the invention will be capable of having a number of areas of application and in connection with a maritime environment will represent a long desired combination, providing comfort when sitting and the necessary sitting height, e.g. in the cockpit of a sailing boat, while at the same time it can be used as a sleeping pad on deck or skerries and in the same way it can be used for support, e.g. when stacking luggage in the cockpit or the like. This is particularly due to the pad's shape conforming properties and stable design with regard to shape. In a maritime environment the pad will also be able to be used as a lifebuoy if the fill in the inner bag is of such a nature that it does not absorb water and provides sufficient buoyancy, which will usually be the case.

The figures illustrate a possible embodiment of the pad according to the invention but they should not be considered to be limiting in relation to the design I and dimensions of the pad. The object of the invention can be used in almost any situation where a sitting, sleeping or support pad is required and with its ability to be shaped and stable characteristics with regard to shape will combine several features to provide a solution which satisfies requirements which at present are covered by several different objects.

What is claimed is:

1. A sitting, sleeping or support pad, comprising:

an outer bag including first and second sides having a substantially rectangular shape to define an outer bag length between outer bag ends of a width less than the outer bag length, and an intermediate piece extending between the first and second sides over at least a part of the outer bag length and throughout at least one outer bag end, the intermediate piece widening toward the at least one outer bag end to provide a wedge-shaped configuration enlarging from a mid portion of the first and second sides to an enlarged end portion along the at least one outer bag end; and at least one inner bag containing a particulate elastic fill material, disposed in the outer bag, and having a size and shape to fit within the outer bag, the inner bag having a degree of fill to permit the reshaping of the pad between sitting, sleeping and supporting applications.

2. The sitting, sleeping or support pad of claim 1, wherein the fill material is selected from a group consisting of materials in pellet or powder form.

3. The sitting, sleeping or support pad of any one of claim 1 or 2, wherein the inner bag has a degree of fill less than 60%.

4. The sitting, sleeping or support pad of claim 3, wherein the inner bag has a degree of fill less than 45%.

5. The sitting, sleeping or support pad of claim 1, wherein the outer bag is designed with at least one pocket.

6. The sitting, sleeping or support pad of claim 1, wherein the outer bag includes fastenings in a central portion thereof for a carrying harness/carrying strap.

7. The sitting, sleeping or support pad of claim 1, wherein the intermediate piece is formed by form sewing of the first and second sides.

8. The sitting, sleeping or support pad of claim 1, wherein the outer bag has at least one opening for removal and insertion of the inner bag.

* * * * *